United States Patent [19]

Elgood et al.

[11] Patent Number: 5,023,602

[45] **Date of Patent: * Jun. 11, 1991**

[54] RASTER GRAPHICAL DISPLAY APPARATUS

[75] Inventors: Mark C. Elgood, Guildford; Richard J. Jales, West Sussex, both of England

[73] Assignee: Sigmex Limited, England

[ * ] Notice: The portion of the term of this patent subsequent to May 9, 2006 has been disclaimed.

[21] Appl. No.: 254,491

[22] Filed: Oct. 6, 1988

Related U.S. Application Data

[63] Continuation of Ser. No. 1,635, filed as PCT GB86/00171 on Mar. 24, 1986, published as WO86/05911 on Oct. 9, 1986, Pat. No. 4,829,291.

[30] Foreign Application Priority Data

Mar. 27, 1985 [GB] United Kingdom ..... 8507988

[51] Int. Cl.[5] ..... G09G 1/16

[52] U.S. Cl. ..... 340/701; 340/703

[58] Field of Search ..... 340/701, 703, 727, 744

[56] References Cited

U.S. PATENT DOCUMENTS

| | | | |
|---|---|---|---|
| 3,911,418 | 10/1975 | Takeda | 340/703 |
| 4,509,043 | 4/1985 | Mossaides | 340/703 |
| 4,543,645 | 9/1985 | Vigarie | 340/703 |
| 4,559,531 | 12/1985 | Buynak | 340/703 |
| 4,580,134 | 4/1986 | Campbell et al. | 340/703 |
| 4,590,463 | 5/1986 | Smollin | 340/703 |
| 4,591,842 | 5/1986 | Clarke, Jr. et al. | 340/703 |
| 4,613,852 | 9/1986 | Maruko | 340/703 |
| 4,829,291 | 5/1989 | Elgood et al. | 340/703 |

*Primary Examiner*—Alvin E. Oberley
*Assistant Examiner*—Richard Hjerpe
*Attorney, Agent, or Firm*—Lucas & Just

[57] ABSTRACT

Computer graphics requiring three dimensional representation needs very fine color shading which is not possible with only 8 planes (bits) per-pixel. In order to provide improved color shading with acceptable resolution a video raster signal, with n (e.g. 8) planes per pixel and based on a resolution of x pixels per line and y lines, can be selectively processed (M1, M2, M3) to provide mn (e.g. 16 or 24) planes per macro-pixel where m is an integer greater than 1 and m=m1.m2 where m1 is the dimension in pixels of each macro-pixel along the scan lines and $m^2$ is the dimension of each macro-pixel transverse to the scan lines (in terms of lines of the normal raster). In one arrangement the 16 planes normally used to drive 3 color guns (red, green and blue) for an odd-even pixel pair are used for providing non-intersecting sets of 5 planes for each of the guns. In another arrangement the 8 planes for odd and even pixels (i.e. 16 planes available) are used for the red and green guns respectively in one scan line of each pair of scan lines and in the other scan line of the pair 8 of the 16 planes are used for the blue gun, each of the guns being operated for 50% of the pixel scanning time.

2 Claims, 4 Drawing Sheets

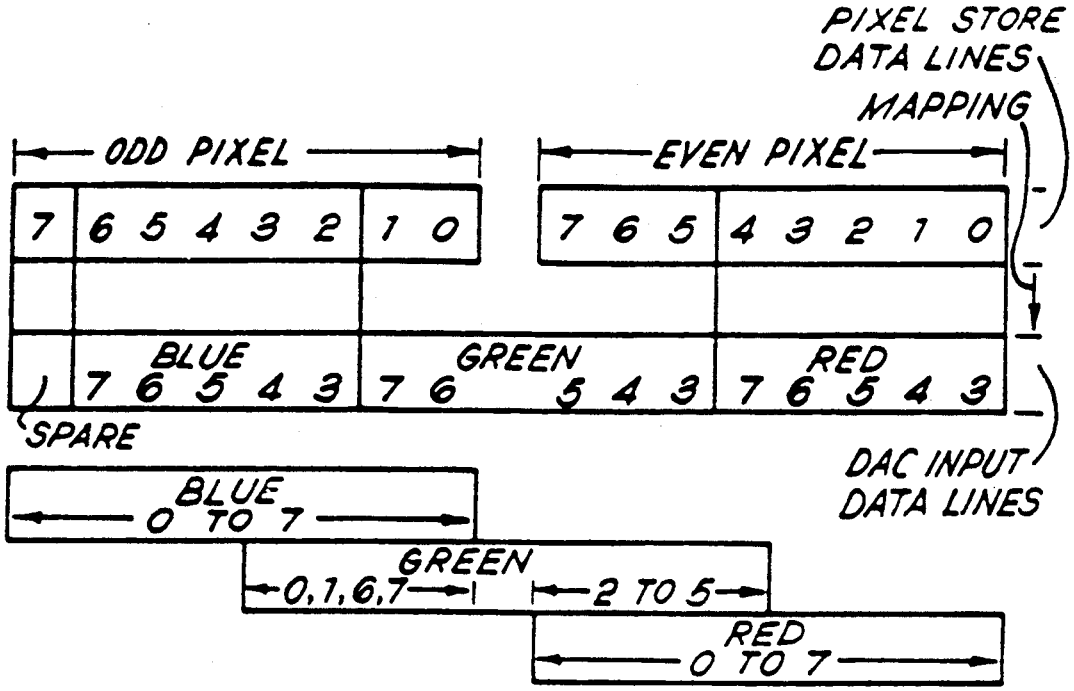
Fig. 3
Fig. 6
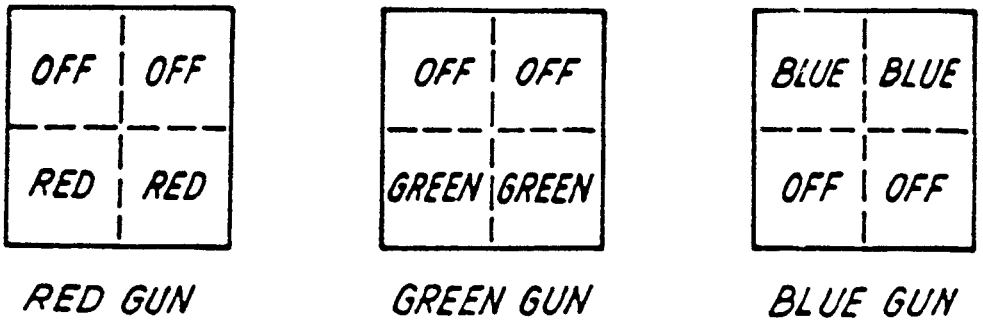

RASTER GRAPHICAL DISPLAY APPARATUS

This is a continuation of application Ser. No. 07/001,635 filed as PCT GB86/00171 on Mar. 24, 1986, published as WO86/05911 on Oct. 9, 1986, now U.S. Pat. No. 4,829,291.

This invention relates to raster graphical display apparatus.

Computer graphics raster color display generators may be classified according to the following parameters:

(a) Spatial Resolution—This is the number of independently definable points or pixels in the x (along the scan lines) and y (normal to the scan lines) axes of the displayed picture.

(b) The number of simultaneous colors which may be displayed. This is determined by the number of bits defining each pixel of the screen, for example four bits allows 2 raised to the power of 4=16, simultaneous colors, 8 bits allow 2 raised to the power 8=256 simultaneous colors. The term bit plane, or simply plane, is used to describe the memory for one bit of the pixel with the x and y resolution defined in (a).

The amount of memory required to support the raster display refresh is linearly proportional to x, y and the number of bits per pixel.

Eight planes, allowing 256 colors to be present on the screen simultaneously, is adequate for most computer graphics such as computer aided design (CAD) and grayscale images but does not provide sufficient simultaneous colors for images with subtle coloring such as 3D shaded images. In such images the distance from the viewer may be shown by fading the colors of parts of the image further from the viewer (called depth cueing) or effects such as reflection and transparency. To achieve subtle shading such as this requires 256 shades of red, 256 shades of blue and 256 shades of green simultaneously calling for 24 bits per pixel.

The cost of pixel store memory to provide twenty four planes is prohibitive for applications which only occasionally require this subtle shading. Such applications are in CAD where much of the graphics consists of assembly drawings, architects drawing, machine drawings and wire frame 3D drawings. These do not require many simultaneous colors, but do require high resolution in x and y to display all of the detail.

Users often require to see a fully shaded, depth-cued 3d image after design to see what the room, building or complex machined part will look like once it has been fabricated. The user would normally produce a 24 bit image in the host computer using processing to remove the parts of the picture which are behind each other (called hidden surface removal) and to add effects such as room lighting, reflection and shadows. It would not normally be possible to display the result unless the graphics system provided 24 planes.

Users of raster graphics equipment require high resolution in x and y raster directions to be able to reproduce fine detail on, for example engineering drawings. It is also desirable to have many bit planes to achieve realistic subtle shading for example to display computer generated images of three dimensional objects (24 bit planes are often used for this purpose). It is unusual to require both high resolution and many bit planes simultaneously and such equipment is expensive due to the amount of pixel store memory required.

According to this invention there is provided raster graphical display apparatus comprising means for providing, in a first mode, a video raster signal based on a resolution of x pixels per line and y lines, a pixel store arranged to provide n planes per pixel and thus $2^n$ color possibilities per pixel, means for selecting a second mode to make available mn planes per macro-pixel in the pixel store, where m is an integer greater than 1 and m=m1.m2 where m1 is the dimension of each macro-pixel along the scan lines and expressed in pixels, and m2 is the dimension of each macro-pixel transverse to the scan lines and expressed in lines of the first mode raster.

In one arrangement m1=2 and m2=2 but each line occurs twice in succession as a line pair (to preserve aspect ratio) to reduce the line resolution so that of the available 4n bit planes per macro-pixel only 2n are distributed between a plurality of color gun drive signals in the same way in both lines of each line pair.

In another preferred arrangement, the planes available per macro-pixel are allocated to different sets of color gun drive signals in respective consecutive lines of each set of m2 lines. Thus where m1=2 and m2=2, 2n planes may be allocated to two (e.g. red and green) color gun drive signals in one line and in the other line of each line pair, n of the 2n available planes may be provided for another (e.g. blue) color gun drive signal so that the effect is of 3n planes per macro-pixel.

Embodiments of this invention will now be described, by way of example, with reference to the accompanying drawings in which:

FIG. 3 is a diagram illustrating bit distribution in the operation of the raster graphical display apparatus shown in FIG. 2;

FIG. 6 is a set of diagrams illustrating color gun drive signal operation for the apparatus shown in FIG. 4.

Figure 1:
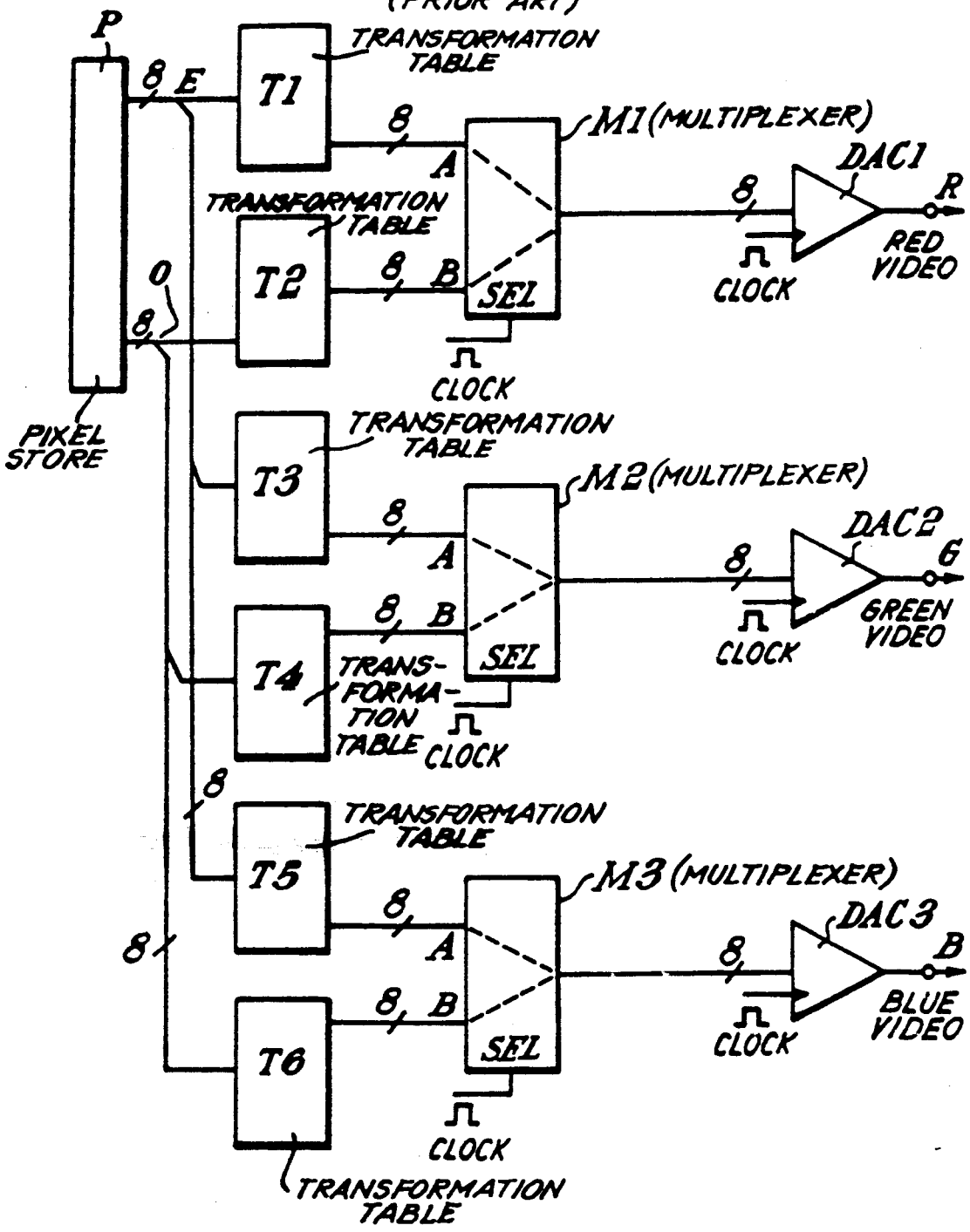
Fig. 1 (PRIOR ART)
FIG. 1 is a block circuit diagram of a portion of conventional raster graphical display apparatus.

Referring to the drawings, in conventional raster graphical display apparatus having a resolution of x pixels per line and y lines per frame, parallel data streams from 8 respective pixel planes in a pixel store P are subjected to interleaving and multiplexing to form two parallel data streams for each plane, one, E, for even pixels and one, O, for odd pixels in the x direction (along the scan lines) of the displayed picture.

The two data streams E, O are supplied to respective transformation tables T1, T2; T3, T4; T5, T6 of each of three color gun drive signal channels associated respectively with the red, green and blue color guns of a display monitor.

The transformation tables each operate in a pre-determined manner to provide a respective output data signal in response to the data input signal which can act as a store address in the transformation table. The transformation tables in each channel provide respective 8 bit output data streams A, B which are input to synchronised multiplexers M1 to M3 which supply respective 8-bit output signals to digital-to-analogue converters DAC1 to DAC3 whose outputs provide color gun drive signals R, G, B. Thus all the color gun signals for a given pixel are derived from the same 8-bit (or plane) input data so that only $2^8=256$ different colors can be provided from pixel to pixel.

Figure 2:
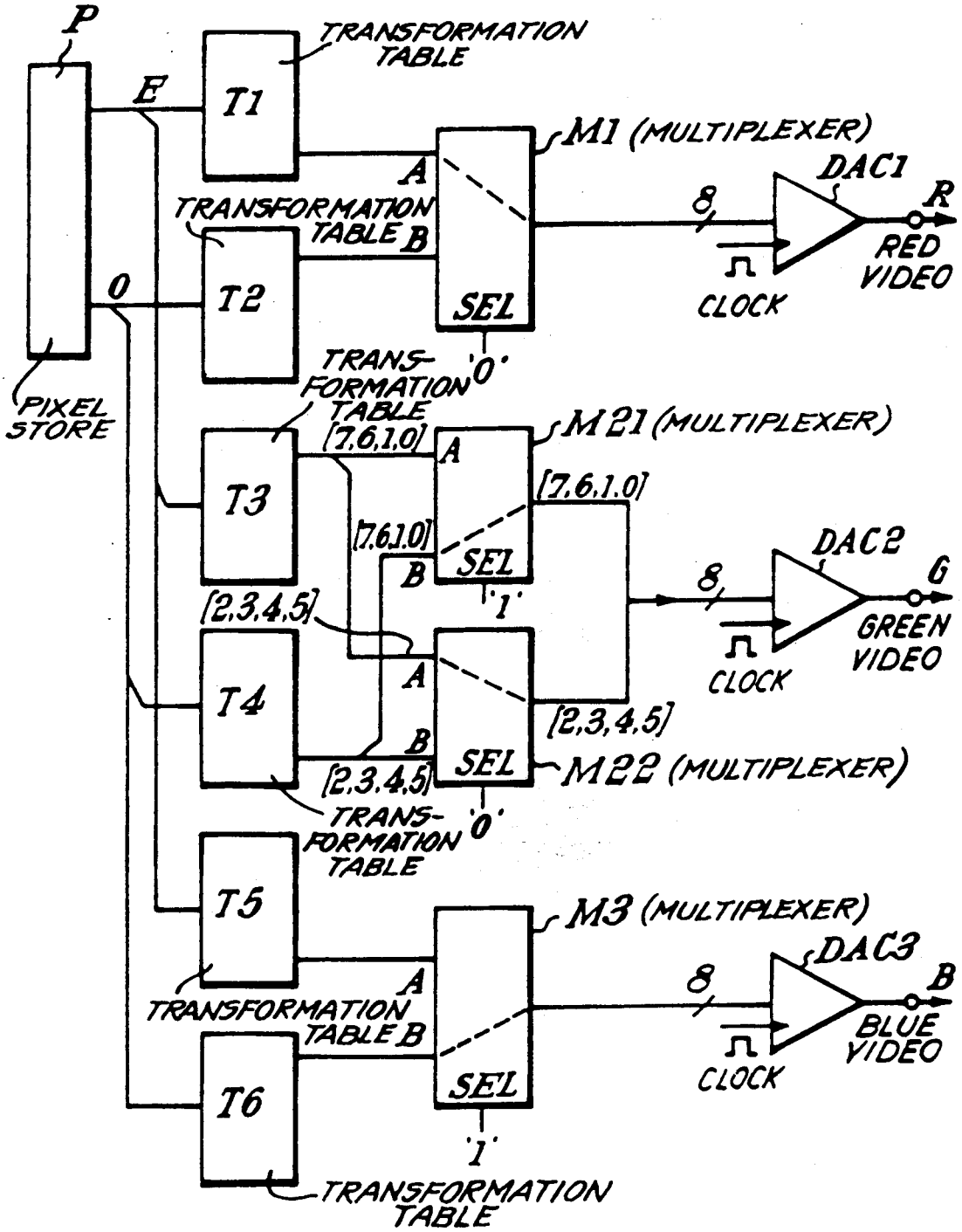
FIG. 2 is a block circuit diagram of a portion of raster graphical display apparatus forming a first embodiment of this invention.

Referring now to FIGS. 2 and 3, there is shown a portion of a raster graphical display apparatus which in a first, standard, mode can effectively operate like the apparatus shown in FIG. 1. In a second mode which can be selected, as illustrated in FIGS. 2 and 3, data is stored in the pixel store on the basis of a reduced resolution of x/2 macro-pixels per line and y/2 lines per frame, with two odd-even (along the scan lines) pairs of standard pixels, displayed over consecutive standard-display lines (comprising each odd-even pair of standard-display lines), combining to form macro-pixels which are $2\times2$ standard pixels in size.

In each line, therefore, there are 16 bits (or planes) available for defining $2^{16}=65536$ different colors from macro-pixel to macro-pixel. Since square pixels are normally required the same color data is used for both odd and even lines of a macro-pixel. The pixel store utilisation can thus be halved in this second mode (e.g. by using only the even rows in the store) and the freed half of the storage capacity (e.g. odd rows in the store) can be used to store a second, different image, the image to be displayed being selected by controlling the line scanning so that both odd and even lines of each odd-even line pair of a displayed picture are produced by means of either the relevant even or the relevant odd row in the pixel store.

Alternatively the freed half of the storage capacity can be used for a 16-bit deep Z buffer for the production (in a manner known per se) of 3-dimensional images within the display apparatus (rather than having to be loaded in from a host computer to which the display apparatus is connected).

In the apparatus shown in FIG. 2, the greenchannel multiplexer arrangement comprises multiplexers M21, M22. The inputs of the multiplexer M21 are respectively arranged to receive the sets of bits 7,6,1,0 of the 8-bit output data streams from the transformation tables respectively associated with the even pixels (along the scan lines) and with the odd pixels. The inputs of the multiplexer M22 are respectively arranged to receive the sets of bits 2,3,4,5 of the 8-bit output data streams from the transformation tables.

In the first, standard 8-plane mode, the multiplexers M21, M22 are switched so that the sets of bits 7,6,1,0 and 2,3,4,5 are combined for the even pixel output signal and then for the odd pixel output signal. The multiplexers M1, M3 are switched synchronously for even and odd pixels.

In the second 16-plane mode, the multiplexer M1 is set to convey the even pixel bits, the multiplexer M3 is set to convey the odd pixel bits, the multiplexer M21 is set to convey the bits 7,6,1,0 of the odd-pixel data stream and the multiplexer M22 is set to convey the bits 2,3,4,5 of the even-pixel data stream. The setting of the multiplexers is achieved by means of setting logic value signals applied to the control signal inputs of the multiplexers.

Only 5 bits of each of the output signals supplied to the digital-to-analogue converters by the multiplexers are used to provide the respective color gun drive signals i.e. a total of 15 bits are used leaving one bit (or plane) spare. However since the bit is available, this mode is referred to as the 16-plane mode. Thus, in the present embodiment, $2^{15}=32768$ different colors are actually provided.

On the assumption that the standard 8-plane mode resolution is $1448\times1024$ pixels the 16-plane mode thus provides a resolution of $724\times512$ macro-pixels without any alteration to the processing rate (i.e. the bandwidth of the apparatus) while retaining a constant scan-line rate so that the standard monitor does not require adjustment or alteration.

The transformation tables for the 16-plane mode can be such that the data output is identical to the address (i.e. no effect) but various alternative mappings may be used for the production of special effects or if an unequal assignment of bits per color channel is required. Additional circuitry would be required if the bit-assignment per color channel is required to be outside the boundaries shown in FIG. 3.

Figure 4:
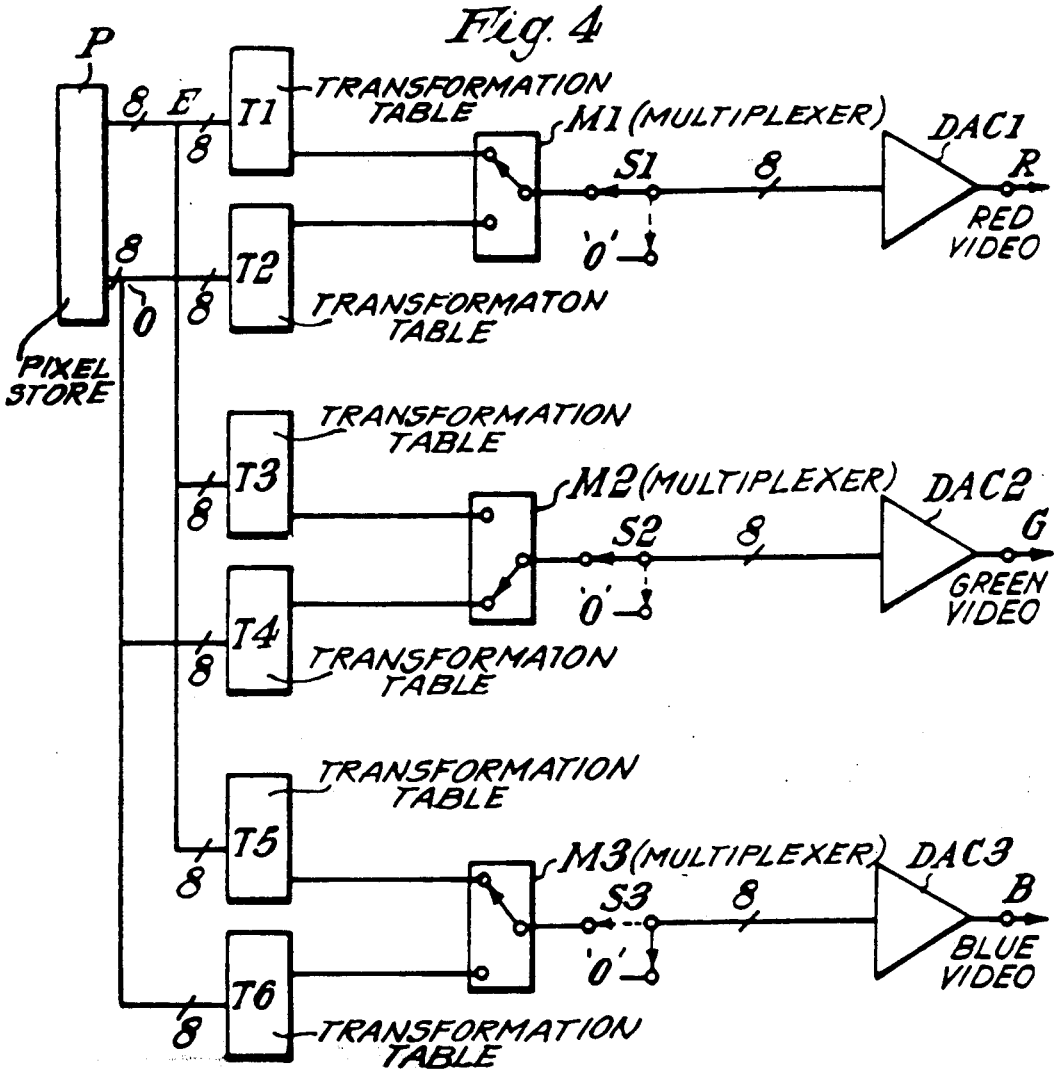
FIG. 4 is a block circuit diagram of a portion of raster graphical display apparatus forming a second embodiment of this invention.
Figure 5:
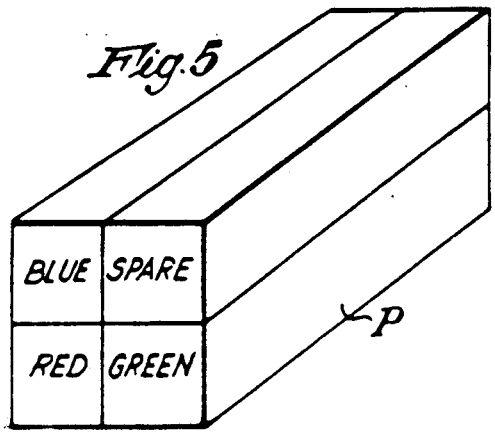
FIG. 5 is a diagram of the pixel store mapping for the apparatus shown in FIG. 4.

Referring now to FIGS. 4 and 5, the apparatus shown is similar to that shown in FIG. 1 except in that, in addition to a first, standard 8-plane mode of operation, the apparatus shown in FIG. 4 has means enabling selection of a second, 24-plane mode of operation.

This second, 24-plane mode is achieved as in the embodiment shown in FIG. 2, by the input of appropriate setting signals to the multiplexers M1 to M3 and by means of switches S1 to S3 respectively connected in series with the outputs of the multiplexers. The switches S1 to S3 can be controlled by means of a control unit C either so as to take up set positions connecting the multiplexer outputs to the digital-to-analogue converters DAC1 to DAC3 (for the standard 8-plane mode) or so as to oscillate between two positions with a period corresponding to the time taken for the scanning of an odd-even line pair (for the 24-plane mode). One of the positions corresponds to the standard 8-plane mode position and the other serves to supply a logic value "0" signal to the digital-to-analogue converters (thus switching off the relevant color guns).

The switch positions are shown respectively in broken line and in solid line to indicate which of the two positions is taken up during odd and even scan lines respectively.

As indicated in FIG. 4, in the 24-plane mode, the multiplexers M1 and M3 are set to transmit only the even pixel bits while the multiplexer M2 is set to transmit only the odd pixel bits. Also the red and green channel switches S1, S2 are arranged to supply color data signals to the digital-to-analogue converters only during the even scan lines while the blue channel switch S3 conveys color data signals only during the odd scan lines.

The corresponding pixel store mapping is shown in FIG. 5 where the set of four stored pixel positions shown corresponds to a single macro-pixel in the 24-plane mode. As shown, the 8 bits determining the blue color gun drive signal occupy a store position corresponding to a standard mode even pixel in an odd scan line while the 8 bit data groups for the red and green channels are respectively in even and odd pixel positions in an even scan line. The remaining odd pixel position in the odd scan line is left spare.

The operation of the apparatus shown in FIG. 5 gives rise to the distribution of color gun drive signals as indicated in FIG. 6 where each color gun operates for 50% of the scanning time for each macro-pixel, the red and green guns operating simultaneously in the even scan lines and the blue gun operating on its own in the odd scan lines. However the effect on the human eye is as if the color possibilities correspond to a total of $2^{24}$ while still utilising the standard single line-rate monitor and without making extra demands on the processing speed of the circuitry.

It should also be noted that although the color guns each operate for 50% of the time, they provide adequate brightness of the display. Finally it is to be noted that flicker is not increased because all information is repeated at the normal frame rate.

The multiplexer control circuit (not shown) is fed with the least significant y scan address to control which situation occurs on any one line. The additional hardware required to achieve scanning in 24 bit mode is minimal and readily available so that both 16 bit and 24 bit modes may now be produced by the same equipment as alternatives to the standard mode, the system firmware controlling two status bits on the video processor.

The pixel stores are filled with image data from the host prior to display. It may be seen that the component pixels and the macro-pixel require the data for each DAC to be placed in different positions dependent on the mode. Hence additional logic has to be provided to speed data transfer by remapping the pixels of the macro-pixel contiguously and thus remapping is mode-dependent. The hardware required for this is not a significant overhead because use could be made of spare sections of the existing mapping logic.

It will be appreciated that the switches S1 to S3 may comprise shift registers acting as multiplexers/latches.

Thus the embodiments described above each provide raster graphical display apparatus comprising means (T1 to T6, M1 to M3 and DAC1 to DAC3) for providing, in a first mode, a video raster signal based on a resolution of x pixels per line and y lines, a pixel store arranged to provide n planes per pixel and thus $2^n$ color possibilities per pixel, means for selecting (M1 to M3m, S1 to S3) a second mode to make available mn planes per macro-pixel in the pixel store, where m is an integer greater than 1 and m=m1.m2 where m1 is the dimension of each macro-pixel along the scan lines and expressed in pixels, and m2 is the dimension of each macro-pixel transverse to the scan lines and expressed in lines of the first mode raster.

We claim:

1. Raster graphical display apparatus comprising means for providing, in a first operating mode, a video raster signal based on a resolution of x pixels per line and y lines where x and y are non-zero integers, a pixel store arranged to provide n planes per pixel where n is a non-zero integer and thus $2^n$ color possibilities per pixel, means for selecting a second operating mode providing a video raster subdivided into micro-pixels and based on a resolution of x/ml macro pixels per line an $y/m^2$ lines, each macro-pixel comprising a rectangular array of pixels to make available mn planes per macro-pixel in the pixel store, where m is an integer greater than 1 and m=m1.m2 where m1 is a non-zero integer denoting the dimension of each macro-pixel along the scan lines and expressed in pixels, and m2 a non-zero integer denoting the dimension of each macro-pixel transverse to the scan lines and expressed in lines of the first operating mode raster, whereby each macro-pixel can contain up to m times as much color information as each pixel for a corresponding trade-off in resolution.

2. Apparatus according to claim 1 wherein means are provided for allocating the planes available per macro-pixel to different sets of color gun drive signal channels in respective consecutive lines of each set of m2 lines.

* * * * *

UNITED STATES PATENT AND TRADEMARK OFFICE

CERTIFICATE OF CORRECTION

PATENT NO. : 5,023,602

DATED : June 11, 1991

INVENTOR(S) : Mark C. Elgood et al.

It is certified that error appears in the above-identified patent and that said Letters Patent is hereby corrected as shown below:

Column 6, line 19, change "an" to --and--.

Signed and Sealed this

Eighth Day of December, 1992

*Attest:*

DOUGLAS B. COMER

*Attesting Officer*

*Acting Commissioner of Patents and Trademarks*